US009466937B2

(12) United States Patent
Yen

(10) Patent No.: US 9,466,937 B2
(45) Date of Patent: Oct. 11, 2016

(54) CRIMPING PLIERS

(71) Applicant: Chao-Chin Yen, New Taipei (TW)

(72) Inventor: Chao-Chin Yen, New Taipei (TW)

( * ) Notice: Subject to any disclaimer, the term of this patent is extended or adjusted under 35 U.S.C. 154(b) by 227 days.

(21) Appl. No.: 14/335,889

(22) Filed: Jul. 19, 2014

(65) Prior Publication Data

US 2015/0040638 A1 Feb. 12, 2015

(30) Foreign Application Priority Data

Aug. 9, 2013 (TW) ..... 102214980 U

(51) Int. Cl.
*H01R 43/042* (2006.01)
*B25B 27/14* (2006.01)
*B25F 1/00* (2006.01)

(52) U.S. Cl.
CPC ..... *H01R 43/042* (2013.01); *B25B 27/146* (2013.01); *B25F 1/00* (2013.01)

(58) Field of Classification Search
CPC ..... B25B 27/146; H01R 43/042; H01R 43/0427; H01R 43/0428; H01R 43/04; H01R 43/015; H01R 43/0421
USPC ..... 72/409.01, 409.14; 29/750, 751, 753, 29/755, 861, 862, 863, 33 M, 758
See application file for complete search history.

(56) References Cited

U.S. PATENT DOCUMENTS 3,837,211 A * 9/1974 Gress ..... H01R 43/0421 29/751
5,105,648 A * 4/1992 Steiner ..... B25B 27/146 29/751
6,173,466 B1 * 1/2001 Chen ..... B25B 27/146 29/33 M
2006/0156784 A1 * 7/2006 Reedy ..... B25B 27/146 72/412

* cited by examiner

*Primary Examiner* — Peter DungBa Vo
*Assistant Examiner* — John S Lowe
(74) *Attorney, Agent, or Firm* — Chun-Ming Shih; HDLS IPR Services

(57) ABSTRACT

A crimping pliers (1) includes a base (10), a guiding plate (20), a crimping member (30) and a compression handle (40). The base (10) includes a receiving space (11), a pivotal attachment portion (13) and an actuation section (14) having a crimping opening (141). The guiding plate (20) with a guiding hole (21) is installed in the receiving space (11) and corresponding to the crimping opening (141). The crimping member (30) is installed inside the receiving space (11) and comprises a connecting rod (31) attached to a sliding member (32) having a crimping portion (322) connected to the guiding hole (21) and corresponding to the crimping opening (141). The compression handle (40) is configured to drive the crimping portion (322) to move inside the crimping opening (141). Therefore, a uniform compression force is ensured to be applied to the connector and the conductive wire by the crimping portion.

12 Claims, 6 Drawing Sheets

CRIMPING PLIERS

BACKGROUND OF THE INVENTION

1. Field of the Invention

The present invention is related to a hand tool, in particular, to a crimping pliers for attaching a conductive wire and a connector firmly together by compression.

2. Description of Related Art

Transmission of signals among electronic products, electronic devices or electronic instruments are typically achieved via the connection between one conductive wire and another conductive wire; whereas the connection between the conductive wire and another conductive wire typically requires the attachment of the conductive wires onto a connector, followed by connecting the connector with another connector in order to allow the electronic connection to be established between the conductive wire and another conductive wire. Nevertheless, the attachment of the conductive wire and the connector typically requires the use of crimping pliers for attaching the conductive wire and the connector firmly together by compression.

A known crimping pliers comprises a compression handle, a base, a crimping member and a compression handle pivotal attachment base. The base includes a crimping opening formed thereon, the crimping member is installed inside the base, and the crimping portion of the crimping member is arranged corresponding to the crimping opening such that when an acting force is exerted on the compression handle to allow the compression handle to move toward the direction of the base, it is able to drive the crimping member inside the base to move in order to allow the crimping portion to move inside the crimping opening. When a connector inserted with a conductive wire is placed into the crimping opening, its crimping portion can then exert a compression on the connector and the conductive wire in order to firmly attach the connector an the conductive wire together.

However, such known crimping pliers still have the following drawbacks. Since guiding slots are provided inside the base for the crimping portion of the crimping member to slide thereon and since the base is typically a plastic unit, the crimping portion is prone to cause damages to the inner wall of the guiding slots due to abrasions thereon; as a result, the crimping portion cannot be maintained to move in a horizontal direction and stable compression forces cannot be applied onto the connector and the conductive wire eventually.

SUMMARY OF THE INVENTION

An objective of the present invention is to provide a crimping pliers which utilizes a crimping portion of a sliding member to slidably connect to a guiding hole of a guiding plate in order to ensure that the crimping portion can be maintained to move horizontally such that the crimping portion is prevented from damaging the inner surface of the guiding hole due to abrasions; therefore, the crimping portion can be ensured to apply a relatively uniform compression force on the connector and the conductive wire.

To achieve the aforementioned objective, the present invention provides a crimping pliers comprising a base, a guiding plate, a crimping member and a compression handle. The base comprises a receiving space and two ends having a pivotal attachment portion and an actuation section formed thereon respectively; the actuation section includes a crimping opening formed there on and connected to the receiving space. The guiding plate is installed in the receiving space and arranged corresponding to the crimping opening. The guiding plate includes a guiding hole formed thereon. The crimping member is installed inside the receiving space; the crimping member comprising a connecting rod and a sliding member; the connecting rod is pivotally attached to the sliding member; the sliding member includes a crimping portion slidably connected to the guiding hole and arranged corresponding to the crimping opening. The compression handle is pivotally attached to the pivotal attachment portion and connected to the connecting rod in order to drive the crimping portion to move inside the crimping opening.

The present invention further includes the following advantageous effects. First, the guiding pin is slidably connected to the sliding slot of the connecting member in order to allow the sliding member to be able to smoothly move along the guiding hole of the guiding plate. Second, with the second cutter moves toward the direction of the first cutter, the effect of cutting off the conductive wire can be achieved. Third, the conductive wire can be placed inside the cut-off slot to allow the second cutter to move toward the direction of the base in order to strip off the cover layer of the conductive wire and to achieve the effect of striping off the cover layer of the conductive wire.

DETAILED DESCRIPTION OF THE INVENTION

The following provides a detailed description of the present invention along with the accompanied drawings; however, it shall be understood that the accompanied drawings are provided for illustrative purposes only, which shall not be treated as limitations of the present invention.

Figure 1:
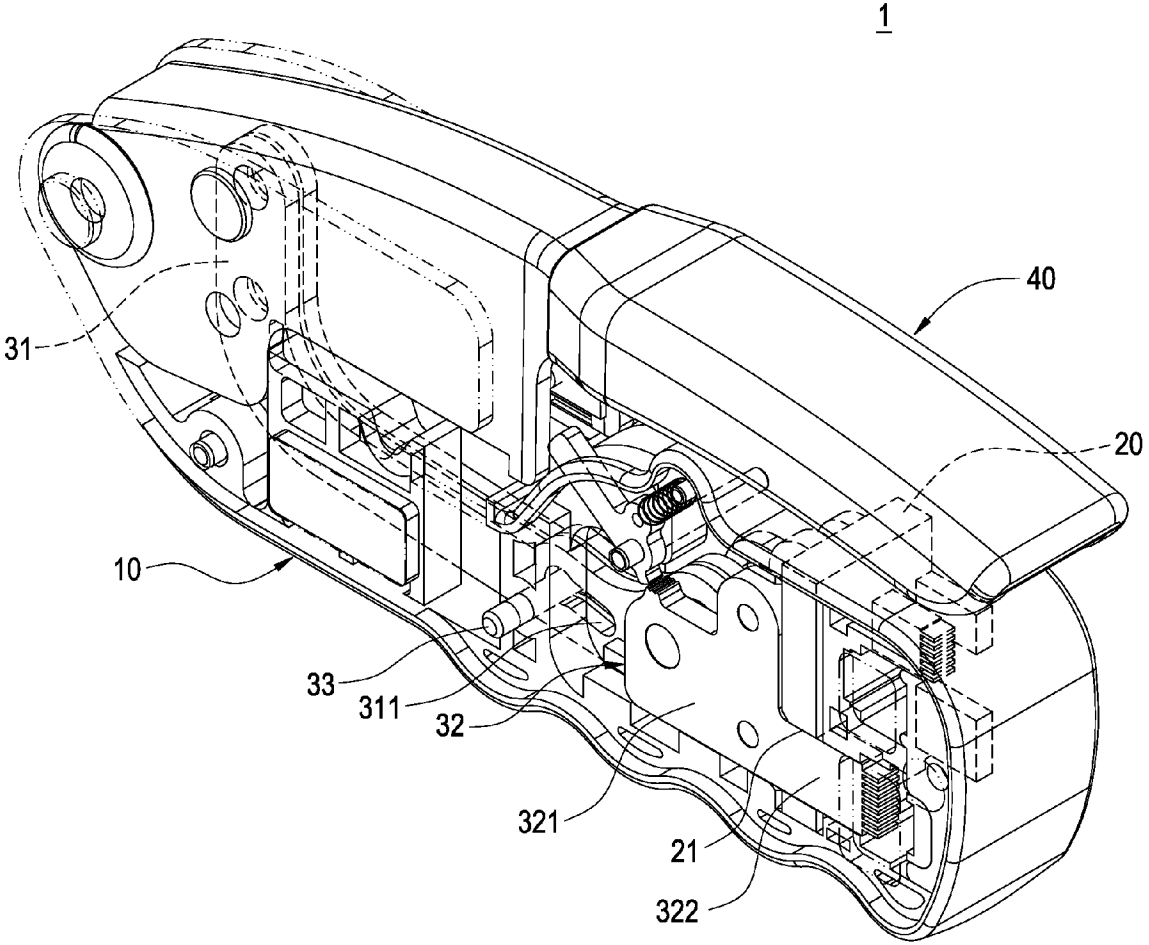
FIG. 1 is a perspective view of the present invention.
Figure 2:
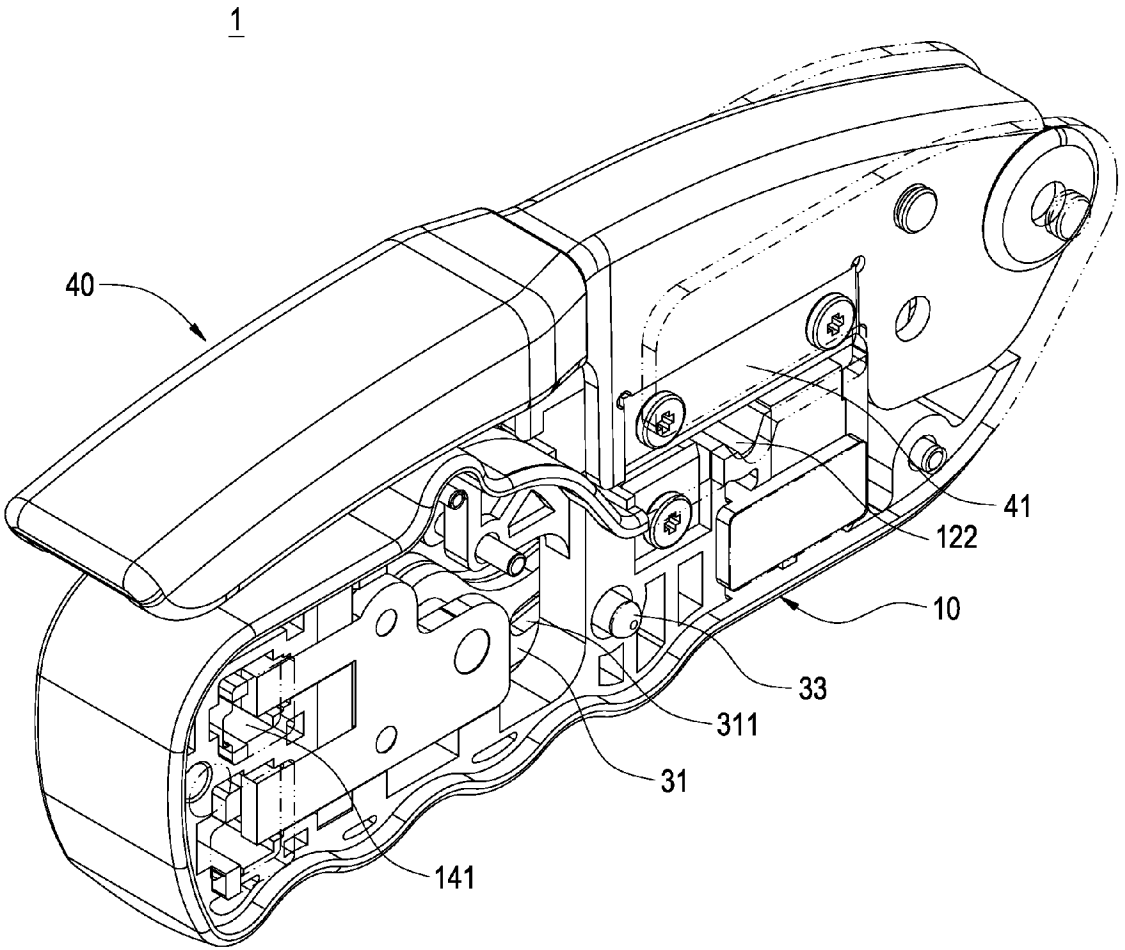
FIG. 2 is another perspective view of the present invention.

Please refer to FIG. 1 and FIG. 2, showing a perspective view and another perspective view of the present invention respectively. The present invention provides a crimping pliers 1 comprising a base 10, a guiding plate 20, a crimping member 30 and a compression handle 40.

Figure 3:
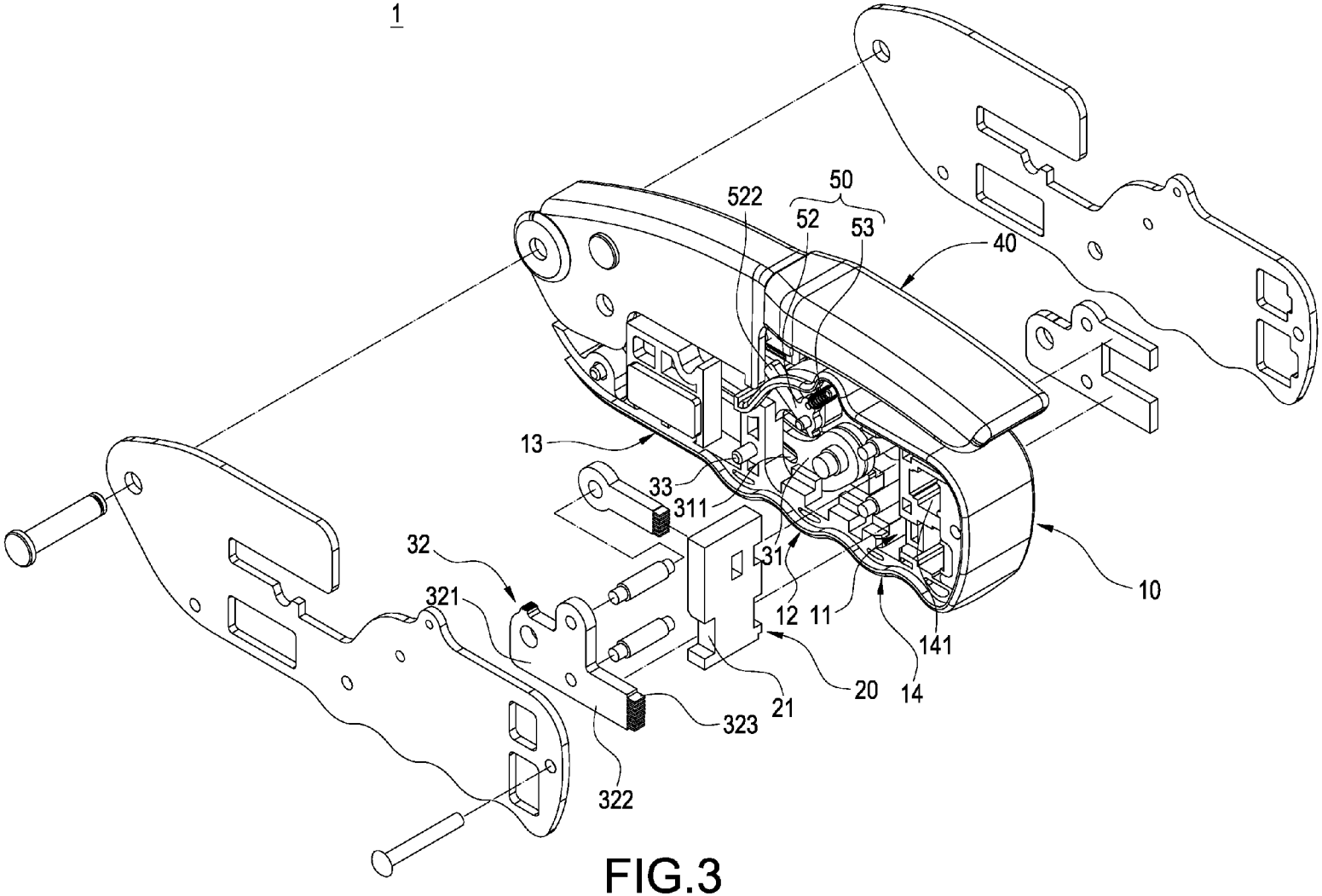
FIG. 3 is an exploded view of present invention.
Figure 4:
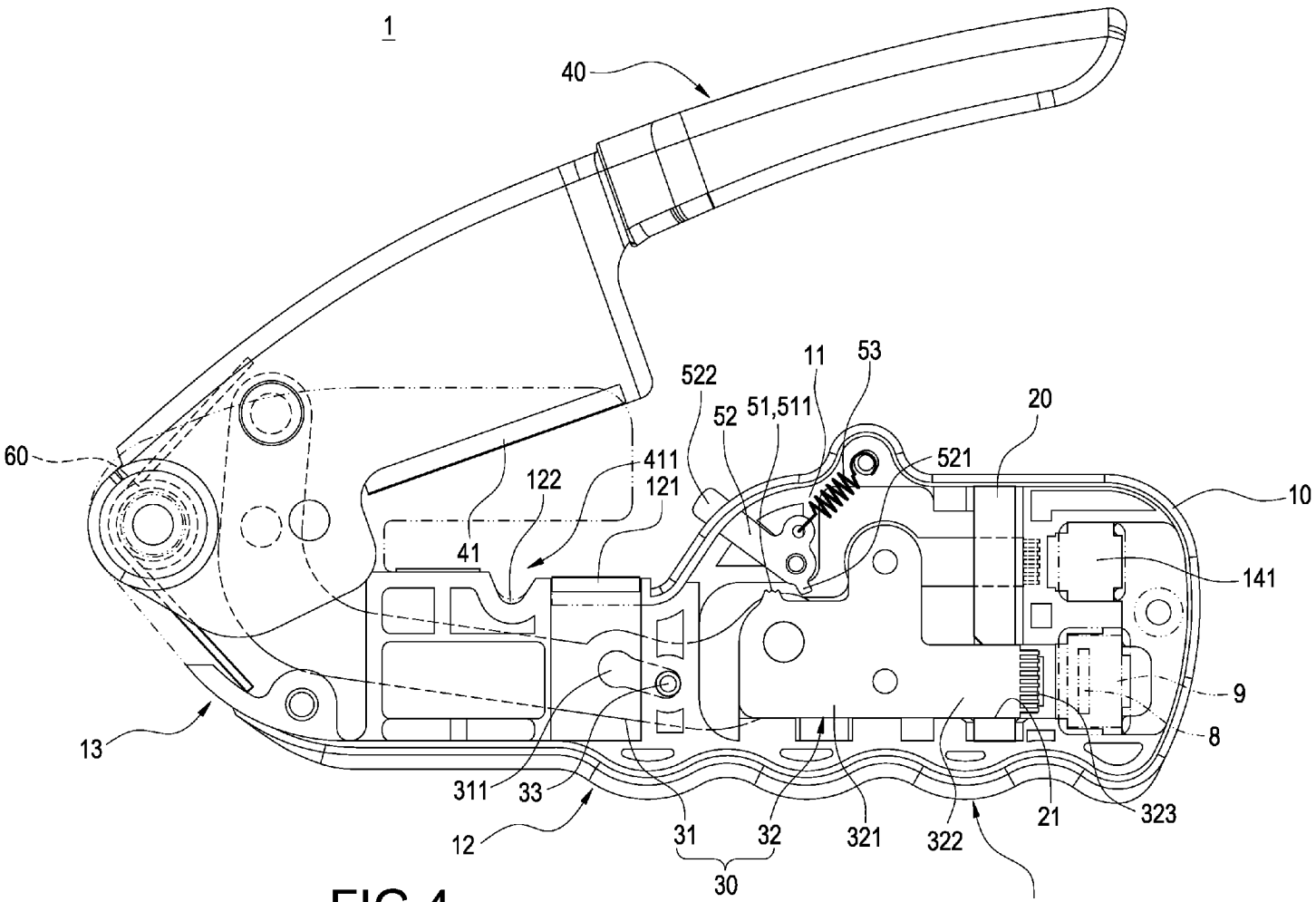
FIG. 4 is a cross sectional view of the present invention.

Please refer to FIG. 3 and FIG. 4, showing an exploded view and a cross sectional view of the present invention respectively. The base 10 includes a receiving space 11, and the base 10 comprises a main body section 12, a pivotal attachment portion 13 and an actuation section 14. The pivotal attachment portion 13 and the actuation section 14 extend from two end portions of the main body section 12 respectively. The upper side of the main body section 12 is installed with a first cutter 121 and includes a cut-out slot 122 formed thereon. The first cutter 121 is adjacent to the pivotal attachment portion 13, and the cut-off slot 122 is located on one side of the first cutter 121. The actuation section 14 includes a crimping opening 141 connected to the receiving space 11. The crimping opening 141 is located on one side the actuation section 14 away from the pivotal attachment portion 13. The base 10 is a unit made of a first material, and the first material is a plastic material.

The guiding plate 20 is installed in the receiving space 11 of the base 10 and arranged corresponding to the crimping opening 141 of the actuation section 14. The guiding plate 20 includes a guiding hole 21 formed thereon. The guiding plate 20 is a unit made of a second material, and the second material is a metal material. An abrasion resistance of the second material is greater than an abrasion resistance of the first material.

The crimping member 30 is installed inside the receiving space 11. The crimping member 30 comprises a connecting rod 31, a sliding member 32 and a guiding pin 33. The connecting rod 31 is pivotally attached to the compression handle 40; the guiding pin 33 is secured onto the main body section 12 of the base 10 and located inside the receiving space 11 of the base 10. The connecting rod 31 includes a sliding slot 311 provided to allow the guiding pin 33 to slidably connected thereto. Two ends of the sliding member 32 include a connecting portion 321 and a crimping portion 322 formed thereon respectively. One end of the connecting rod 31 away from the pivotal attachment portion 13 is pivotally attached to the connecting portion 321. The crimping portion 322 is slidably connected to the guiding hole 21 of the guiding plate 20 and arranged corresponding to the crimping opening 141 of the actuation section 14. One end surface of the crimping portion 322 away from the connecting portion 321 includes a plurality of crimping teeth 323 formed thereon.

The compression handle 40 is pivotally attached to the pivotal attachment portion 13 and connected to the connecting rod 31. When an acting force is exerted onto the compression handle 40, the compression handle 40 rotates toward the direction of the base 10 in order to drive the crimping portion 322 of the sliding member 32 to move along the guiding hole 21 of the guiding plate 20 and to move inside the crimping opening 141. One side of the compression handle 40 adjacent to the main body section 12 is installed with a second cutter 41 arranged corresponding to the first cutter 121. The cut-off slot 122 is located on one side of the main body section 12 adjacent to the second cutter 41. A wire stripping area 411 is formed between the second cutter 41 and the cut-off slot 122.

The crimping pliers 1 further comprises a positioning mechanism 50 and a torsion spring 60.

The positioning mechanism 50 is installed inside the receiving space 11 of the base 10. The positioning mechanism 50 comprises a pawl member 51, a detention member 52 and an elastic member 53. The pawl member 51 includes a plurality of pawl teeth 511 formed at the connecting portion 321 of the sliding member 32. The detention member 52 is pivotally attached to the actuation section 14 of the base 10. Two ends of the detention member 52 include a detention piece 521 and a compression pin 522 extended therefrom respectively. The detection piece 521 is locked onto the plurality of pawl teeth 511 for detection with each other. One end of the compression pin 522 away from the detention member 52 penetrates through the base 10 in order to be exposed at an outer of the base 10. Two ends of the elastic member 53 are connected to the base 10 and an intersection between the detention member 52 and the compression pin 522 respectively. The elastic spring 53 is a spring.

The torsion spring 60 is installed at a pivotal attachment area between the compression handle 40 and the pivotal attachment portion 13.

Figure 5:
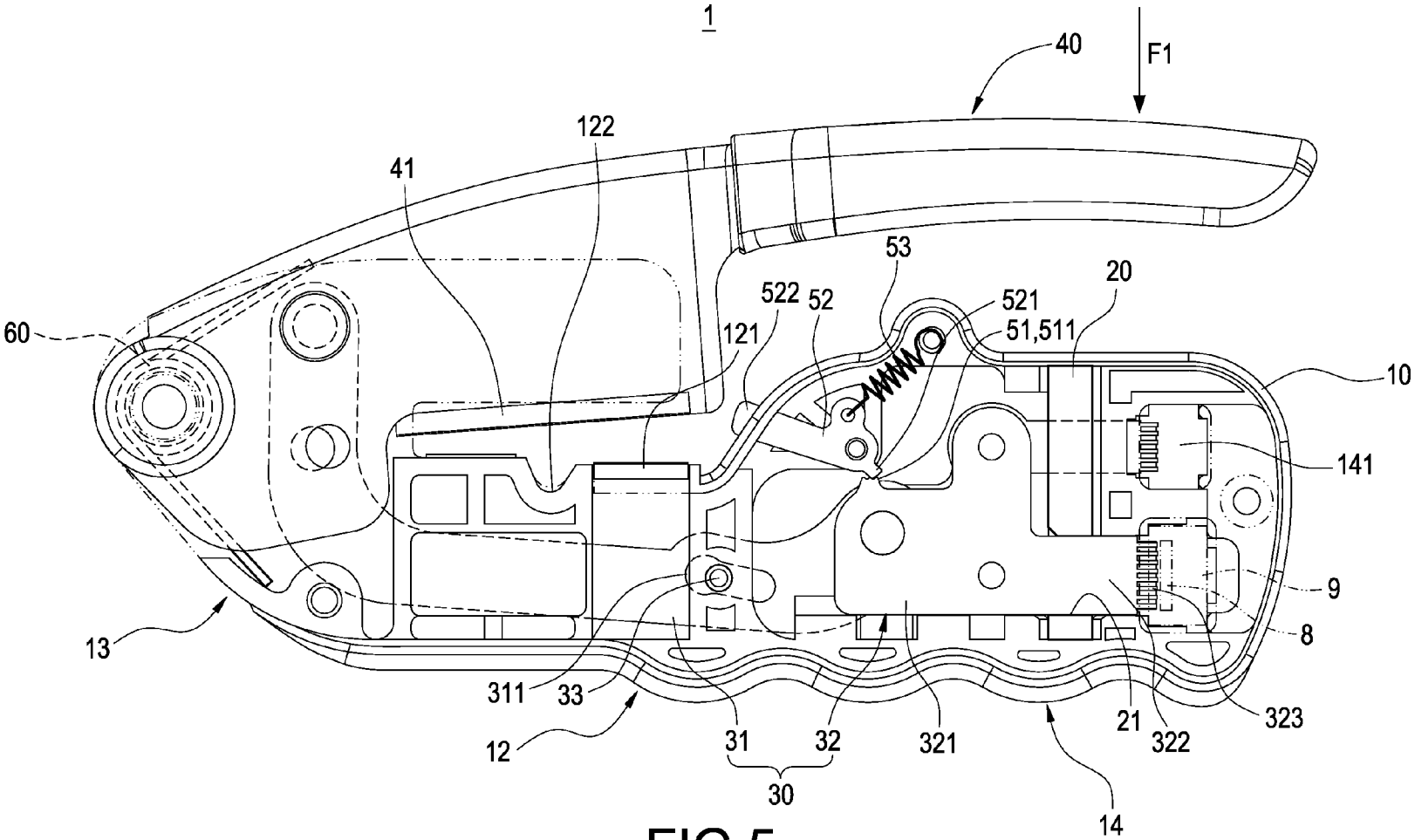
FIG. 5 is an in-use state view of the present invention.
Figure 6:
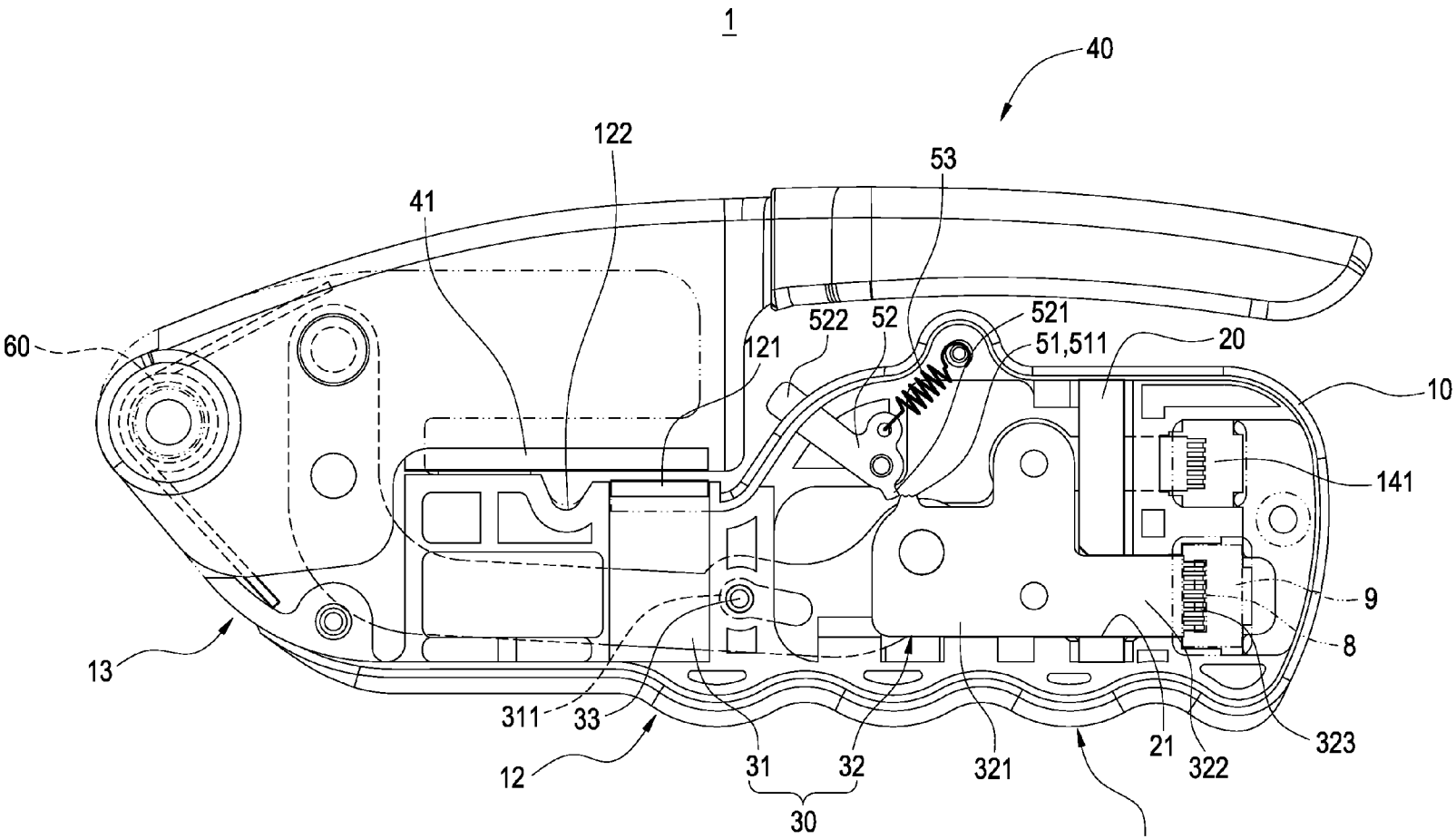
FIG. 6 is another in-use state view of the present invention.

Please refer to FIG. 5 and FIG. 6, showing an in-use state view and another in-use state view of the present invention respectively. When the conductive wire 8 is to be attached to the connector 9, first, the conductive wire 8 is penetrated into the connector 9, followed by inserting the connector 9 into the crimping opening 141 of the actuation section 14. Then, an acting force F1 is exerted onto the compression handle 40 to allow the compression handle 40 to move toward the direction of the base 10 in order to drive the connecting rod 31 to move toward the direction of the main body section 12 as well as to allow the connecting rod 31 to push the sliding member 32 to move toward the direction of the actuation section 14 such that the crimping portion 322 of the sliding member 32 slides along the guiding hole 21 of the guiding plate 20 to move into the crimping opening 141. Consequently, the crimping teeth 323 of the crimping portion 322 apply a compression force onto the connector 9 in order to crimp the connector 9 and the conductive wire 8 firmly together as one single unit.

With the utilization of the crimping portion 322 of the sliding member 32 slidably connected to the guiding hole 21 of the guiding plate 20, the crimping portion 322 of the sliding member 32 can move along the guiding hole 21 of the guiding plate 20 in order to allow the movement of the crimping portion 322 of the sliding member 32 to be a horizontal movement such that a relatively uniform compression force is ensured to be applied onto the connector 9 and the conductive wire 8 by the crimping portion 322; therefore, the crimping effect applied to the connector 9 and the conductive wire 8 by the crimping portion 322 is enhanced. In addition, since the guiding plate 20 is a metal material and has an abrasion resistance greater than the abrasion resistance of the base 10, the inner wall of the guiding hole 21 of the guiding plate 20 is not likely to be damaged by the crimping portion 322 of the sliding member 32 due to abrasions thereon in order to prevent the situation where the crimping portion 322 of the sliding member 32 cannot be maintained to move in a horizontal direction after a long period of use of the crimping pliers and the situation where non-uniform forces are being applied onto the connector 9 and the conductive wire 8 by the crimping portion 322. Accordingly, the useful lifetime of the crimping pliers 1 can also be further prolonged.

In addition, since the guiding plate 20 can be easily installed into the receiving space 11 of the base 10, it can also be detached from the receiving space 11 of the base 10 with ease. Therefore, when the guiding hole 21 of the guiding plate 20 is damaged due to abrasions, it can also be detached from the receiving space 11 of the old guiding plate 20 in order to allow a new guiding plate 20 to be installed into the receiving space 11 of the base 10 such that the effect of facilitated maintenance and repair thereof can be achieved.

Furthermore, the guiding pin 33 is slidably connected to the sliding slot 311 of the connecting rod 31; therefore, the connecting rod 31 is able to move under the guidance of the guiding pin 33 in order to ensure that pushing forces in an identical direction can be repeatedly provided to the sliding member 32 such that the sliding member 32 is able to move smoothly along the guiding hole 21 of the guiding plate 20.

Moreover, the conductive wire 8 can be placed between the first cutter 121 and the second cutter 41; with the acting force F1 being exerted onto the compression handle 40, it can be moved toward the direction of the base 10 in order to drive the second cutter 41 to move toward the direction of the first cutter 121 such that the effect of cutting off the conductive wire 8 can be achieved. In addition, if the cover layer of the conductive wire 9 is to be stripped off in order to allow the bare wire of the conductive wire to be exposed, the conductive wire 8 can be placed inside the cut-off slot 122, followed by exerting the acting force F1 onto the compression handle 40 to drive the second cutter 41 to move toward the direction of the base 10 in order to strip off the cover layer of the conductive wire 8 such that the effect of stripping off the cover layer of the conductive wire 8 can be achieved.

In view of the above, the crimping pliers of the present invention is of industrial applicability, novelty and inventive step while there is no similar or identical products or designs in the market; therefore, the present invention complies with the patentability for the grant of a patent and is applied legitimately in the application.

What is claimed is:

1. A crimping pliers (1), comprising:

a base (10) comprising a receiving space (11) and two ends having a pivotal attachment portion (13) and an actuation section (14) formed thereon respectively; the actuation section (14) having a crimping opening (141) formed thereon and connected to the receiving space (11);

a guiding plate (20) installed in the receiving space (11) and arranged corresponding to the crimping opening (141); the guiding plate (20) having a guiding hole (21) formed thereon;

a crimping member (30) installed inside the receiving space (11); the crimping member (30) comprising a connecting rod (31) and a sliding member (32); the connecting rod (31) pivotally attached to the sliding member (32); the sliding member (32) having a crimping portion (322) slidably connected to the guiding hole (21) and arranged corresponding to the crimping opening (141);

a compression handle (40) pivotally attached to the pivotal attachment portion (13) and connected to the connecting rod (31) in order to drive the crimping portion (322) to move inside the crimping opening (141), wherein one end of the sliding member (32) away from the crimping portion (322) includes a connecting portion (321); the connecting rod (31) is pivotally attached to the connecting portion (321); and a positioning mechanism (50) installed inside the receiving space (11) and comprising a pawl member (51), a detention member (52) and an elastic member (53); the pawl member (51) being formed on the connecting portion (321); the detention member (52) being pivotally attached to the actuation section (14) and locked onto the pawl member (51) for detention with each other; two ends of the elastic member (53) being connected to the base (10) and the detention member (52) respectively, wherein the pawl member (51) includes a plurality of pawl teeth (511) formed on the connecting portion (321); the detention member (52) is locked onto the plurality of pawl teeth (511) for detention with each other, and wherein two ends of the detention member (52) include a detention piece (521) and a compression pin (522) extended therefrom respectively; the detention piece (521) is locked onto the plurality of pawl teeth (511) for detention with each other; the elastic member (53) is connected to an intersection between the compression pin (522) and the detention member (52); one end of the compression pin (522) away from the detention member (52) extends to penetrate through the base (10) in order to be exposed at an outer of the base (10).

2. The crimping pliers according to claim 1, wherein the crimping member (30) further comprising a guiding pin (33); the base (10) further includes a main body section (12); the pivotal attachment portion (13) and the actuation section (14) extend from two end portions of the main body section (12) respectively; the guiding pin (33) is secured on the main body section (12) and located in the receiving space (11); the connecting rod (31) includes a sliding slot (311) provided to allow the guiding pin (33) to slide thereon.

3. The crimping pliers according to claim 1, wherein one end surface of the crimping portion (322) away from the connecting portion (321) includes a plurality of crimping teeth (323) formed thereon.

4. The crimping pliers according to claim 1, wherein the elastic member (53) is a spring.

5. The crimping pliers according to claim 2, wherein the main body section (12) is installed with a first cutter (121); one side of the compression handle (40) adjacent to the main body section (12) is installed with a second cutter (41) arranged corresponding to the first cutter (121).

6. A crimping pliers (1), comprising:

a base (10) comprising a receiving space (11) and two ends having a pivotal attachment portion (13) and an actuation section (14) formed thereon respectively; the actuation section (14) having a crimping opening (141) formed thereon and connected to the receiving space (11);

a guiding plate (20) installed in the receiving space (11) and arranged corresponding to the crimping opening (141); the guiding plate (20) having a guiding hole (21) formed thereon;

a crimping member (30) installed inside the receiving space (11); the crimping member (30) comprising a connecting rod (31) and a sliding member (32); the connecting rod (31) pivotally attached to the sliding member (32); the sliding member (32) having a crimping portion (322) slidably connected to the guiding hole (21) and arranged corresponding to the crimping opening (141); and a compression handle (40) pivotally attached to the pivotal attachment portion (13) and connected to the connecting rod (31) in order to drive the crimping portion (322) to move inside the crimping opening (141), wherein the crimping member (30) further comprising a guiding pin (33); the base (10) further includes a main body section (12); the pivotal attachment portion (13) and the actuation section (14) extend from two end portions of the main body section (12) respectively; the guiding pin (33) is secured on the main body section (12) and located in the receiving space (11); the connecting rod (31) includes a sliding slot (311) provided to allow the guiding pin (33) to slide thereon;

wherein the main body section (12) is installed with a first cutter (121); one side of the compression handle (40) adjacent to the main body section (12) is installed with a second cutter (41) arranged corresponding to the first cutter (121);

wherein one side of the main body section (12) adjacent to the second cutter (41) includes a cut-out slot (122); the cut-out slot (122) is located on one side of the first cutter (121); a wire stripping area (411) is formed between the second cutter (41) and the cut-out slot (122).

7. The crimping pliers according to claim 1, further comprising a torsion spring (60); the torsion spring (60)

being installed at a pivotal attachment area between the compression handle (40) and the pivotal attachment portion (13).

8. The crimping pliers according to claim 1, wherein the base (10) is a unit made of a first material; the guiding plate (20) is a unit made of a second material; an abrasion resistance of the second material is greater than an abrasion resistance of the first material.

9. The crimping pliers according to claim 8, wherein the first material is a plastic material; the second material is a metal material.

10. The crimping pliers according to claim 6, further comprising a torsion spring (60); the torsion spring (60) being installed at a pivotal attachment area between the compression handle (40) and the pivotal attachment portion (13).

11. The crimping pliers according to claim 6, wherein the base (10) is a unit made of a first material; the guiding plate (20) is a unit made of a second material; an abrasion resistance of the second material is greater than an abrasion resistance of the first material.

12. The crimping pliers according to claim 11, wherein the first material is a plastic material; the second material is a metal material.

* * * * *